US005105886A

United States Patent [19]

Strubhar et al.

[11] Patent Number: 5,105,886

[45] Date of Patent: Apr. 21, 1992

[54] METHOD FOR THE CONTROL OF SOLIDS ACCOMPANYING HYDROCARBON PRODUCTION FROM SUBTERRANEAN FORMATIONS

[75] Inventors: Malcolm K. Strubhar, Irving, Tex.; John C. Healy, Metairie, La.

[73] Assignee: Mobil Oil Corporation, Fairfax, Va.

[21] Appl. No.: 602,566

[22] Filed: Oct. 24, 1990

[51] Int. Cl.[5] ..... E21B 43/267; E21B 43/04

[52] U.S. Cl. ..... 166/280; 166/281; 166/295; 166/297

[58] Field of Search ..... 166/280, 281, 295, 297, 166/308

[56] References Cited

U.S. PATENT DOCUMENTS

| | | | |
|---|---|---|---|
| 3,854,533 | 12/1974 | Gurley et al. | 166/281 X |
| 3,929,191 | 12/1975 | Graham et al. | 166/276 |
| 4,518,039 | 5/1985 | Graham et al. | 166/280 X |
| 4,549,608 | 10/1985 | Stowe et al. | 166/281 X |
| 4,564,459 | 1/1986 | Underdown et al. | 166/280 X |
| 4,694,905 | 9/1987 | Armbruster | 166/280 |
| 4,875,525 | 10/1989 | Mana | 166/280 |
| 4,888,240 | 12/1989 | Graham et al. | 428/403 |
| 4,960,171 | 10/1990 | Parrott et al. | 166/297 X |
| 4,977,961 | 12/1990 | Auasthi | 166/297 |

*Primary Examiner*—George A. Suchfield

*Attorney, Agent, or Firm*—Alexander J. McKillop; Charles J. Speciale; Charles A. Malone

[57] ABSTRACT

A method for gravel packing a wellbore where a resin-coated sand or "gravel" is utilized. First, the wellbore is perforated at the productive interval in a manner sufficient to hydraulically fracture the formation. Afterwards, the formation is hydraulically fractured via a frac fluid containing a resin-coated sand. During this fracturing operation, a resultant fracture is propped with the resin-coated sand. The frac fluid is pumped down the wellbore until "screen out" occurs at perforations in the wellbore. The resin-coated sand is allowed to remain in the fracture, perforations, and wellbore until a permeable, porous consolidated mass is formed. After the mass has formed, excess consolidated sand is removed from the wellbore. When the formation is produced, formation solids are contained by the consolidated mass in the fracture and perforations.

7 Claims, 1 Drawing Sheet

METHOD FOR THE CONTROL OF SOLIDS ACCOMPANYING HYDROCARBON PRODUCTION FROM SUBTERRANEAN FORMATIONS

FIELD OF THE INVENTION

This invention relates to a method for controlling the production of solids from weakly cemented or unconsolidated formations during flow of hycrocarbon fluids from said formations.

BACKGROUND OF THE INVENTION

Frequently, when producing hydrocarbon fluids, e.g., oil and/or gas, from a formation, solids are produced along with the fluids. These solids can range in particle size from very fine silt to very coarse grained material, depending on the nature of the formation. Formations that produce solids vary from totally unconsolidated (uncemented) to weakly cemented. Formations having significant compressive strength of about 500 psi or greater, do not produce solids under normal operating conditions.

Various techniques are employed for controlling the production of these solids. One such technique is called gravel packing. Gravel packing involves filling an annulus or annular space between a casing and a retaining screen with a sieved particulate such as sand, the casing having been previously perforated. For best results for well productivity, sand also is placed into and through the perforation tunnels using pumping techniques. Subsequently, as the well is produced, sand serves as a filter media to restrain the movement and production of formation solids. The screen, in turn, prevents the movement of the sieved sand or "gravel".

In the practice of gravel packing, the major restriction to flow occurs in "gravel" filled perforation tunnels. This restriction is minimized by utilizing as large a perforation density as is practical and appropriate. For example, in conventional completions where gravel packing is not used, perforation densities rarely exceed four shots per foot (SPF) and are frequently less. In gravel packing operations, perforation densities are commonly 8–16 SPF.

When performing gravel packing operations, sand or "gravel" is mixed with an appropriate fluid into a slurry and pumped down the wellbore in a manner designed to fill the perforation tunnels and any voids that might exist outside the casing. Also, of course, the annular space between casing and retaining screen is filled. While successful in the majority of applications, gravel packs frequently fail to control solids production. A prime cause of failures occurs when the spaces designed to be filled with "gravel" are incompletely packed for one reason or another. As a result, voids are left in the pack. During subsequent production, formation solids are produced through them. For these reasons, placement of gravel becomes a major operational consideration in achieving successful gravel packs.

Therefore, what is needed is a method for effectively gravel packing a wellbore which packing will fill all desired spaces.

SUMMARY OF THE INVENTION

This invention is directed to a method for controlling solids contained in hydrocarbonaceous fluids which are produced from a subterranean formation. In the practice of this invention, a wellbore penetrating a hydrocarbonaceous fluid-containing formation is perforated at its productive interval. Thereafter, a fracturing fluid containing a resin-coated particulate material, of a size and composition sufficient to prop a created fracture, is injected into said productive interval via perforations contained in the wellbore. Subsequently, the productive interval is hydraulically fractured through the productive interval so as to create a fracture which is propped with the resin-coated particulate material.

This particulate material is allowed to remain in the fracture and the wellbore for a time sufficient to form a permeable, porous consolidated mass in the fracture and wellbore. This permeable consolidated mass has filtration properties sufficient to prevent solids, contained in the hydrocarbonaceous fluid, from entering into the wellbore.

In order for hydrocarbonaceous fluids to flow into the wellbore at acceptable rates, excess consolidated permeable mass is removed from the wellbore by drilling and circulating the excess from the wellbore. Once the well is placed in production, formation fines or solid material entrained in the hydrocarbonaceous fluid is removed from the fluid by the consolidated permeable mass formed in the fracture and packed perforations.

It is therefore an object of this invention to provide a method for improved gravel placement in perforations and a created fracture, as well as voids adjacent to a well.

It is another object of this invention to gravel pack a wellbore without need for a retaining screen.

DESCRIPTION OF THE PREFERRED EMBODIMENT

In accordance with the present invention, a wellbore is placed into a productive interval of a formation. After placement of the wellbore into the formation, perforations are directed through the casing and cement into the productive interval. A fracturing fluid is prepared so as to contain a resin-coated particulate material. This material is of a size and composition sufficient to prop a created fracture. Thereafter, the coated particulate material will form a consolidated mass in the fracture.

Subsequently, the formation is hydraulically fractured and propped with the coated particulate material. Excess particulate material is deposited in the wellbore during the fracturing operations. The resin-coated particulate material is allowed to remain in the fracture and wellbore for a time sufficient to form a permeable, porous consolidated mass. This permeable mass has filtration characteristics sufficient to prevent solids from being produced to the surface which solids are entrained in a hydrocarbonaceous fluid produced from said formation. The permeable, porous consolidated mass forms a plug in the wellbore. This plug is mechanically removed from the wellbore. However, the permeable, porous consolidated mass remains in the fracture, formation voids adjacent the well, and the perforations so as to prevent the production of formation fines or solids into the wellbore when the well is produced.

Figure 1:
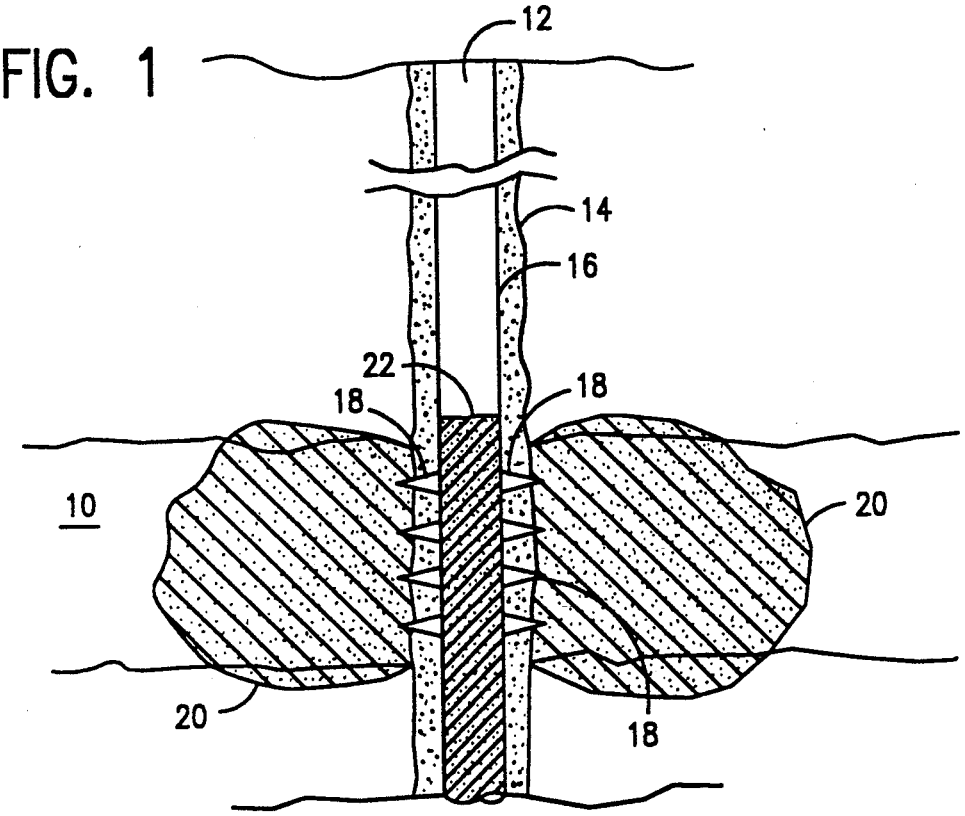
FIG. 1 is a schematic representation of a formation penetrated by a wellbore which depicts a hydraulic fracture and wellbore filled with a permeable, porous consolidated mass.

In the practice of this invention, referring to FIG. 1, wellbore 12 penetrates formation 10. Wellbore 12 contains a cement sheath 14 and casing 16. Perforation tunnels 18 penetrate cement sheath 14 and casing 16. Thereafter, a fracturing fluid is injected into well 12. This fracturing fluid contains a resin-coated particulate material. This resin-coated particulate material is placed in the fracturing fluid in an amount sufficient to prop created fracture 20 and also to fill perforation tunnels 18. The coated particulate material is also of a size and strength sufficient to prop fracture 20. Additionally, it is also of a size and composition to form a permeable, porous consolidated mass in created fracture 20.

The fracturing or "frac" fluid is injected into well 12 and into the productive interval of formation 10 at rates and pressures sufficient to create a hydraulic fracture. Upon entering the fracture, fluid leaves the resin-coated material and drains into formation 10. Fracturing fluid is continually pumped into wellbore 12 until such time as "sand out" or "screen out" occurs in the fracture as well as perforation tunnels 18. As the liquid portion of the fracturing fluid leaks off into formation 10, the resin-coated particulated material forms a plug 22 within wellbore 12. The "screen out" results in a fill-up of well 12 to a predetermined level above the perforations. Once a fracture has been formed to the extent desired in formation 10, hydraulic fracturing is terminated.

Figure 2:
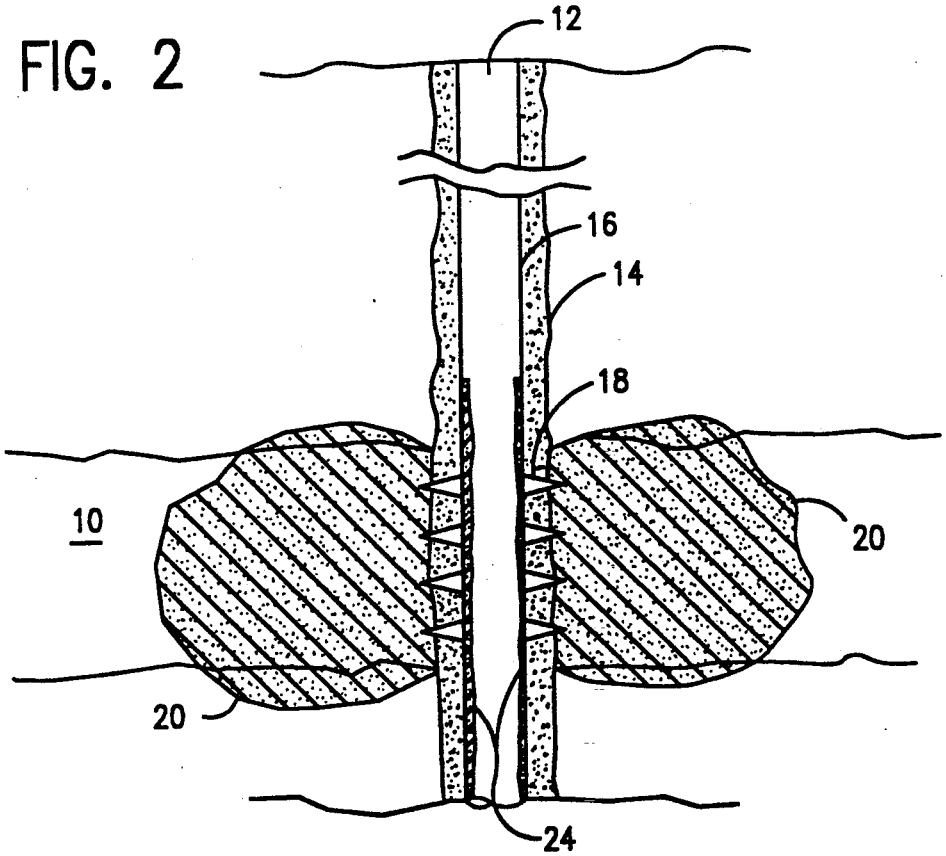
FIG. 2 is a schematic representation which shows a fracture and perforations filled with the permeable, porous consolidated mass which mass has been removed from the wellbore.

The resin-coated particulate material which has been injected into fracture 20, wellbore 12, and any voids adjacent thereto, forms a permeable, porous consolidated mass in fracture 20, said voids, and a permeable, porous consolidated plug in wellbore 12. The resin-coated particulate materials solidify into a consolidated, porous, permeable body with a desired compressive strength. Consolidation time depends on the fluid, oil or water base, used for pumping as well as bottom hole temperature and pressure conditions. When the consolidation process achieves a designed and predetermined compressive strength, the resin-coated particulate material in the wellbore is drilled out and excess material is circulated to the surface. The size of the hole drilled through the consolidated mass or resin consolidated "gravel" plug can be regulated by the size of the drill bit utilized that is affixed to a drill string. Centralization of the drill string with stabilizer assemblies may also be desirable. After completion of the drilling and cleaning out process when the permeable, porous consolidated mass has been removed from wellbore 12, a thin layer 24 of resin-coated gravel may remain in wellbore 12. This is depicted in FIG. 2. After the porous consolidated mass has been removed from wellbore 12, the perforations and fracture remain packed with the consolidated porous mass.

Prior to hydraulically fracturing the formation, perforation tunnels 18 are placed in wellbore 12. These perforation tunnels are made by utilization of perforation guns which methods are known to those skilled in the art. The density of perforation tunnels 18 in wellbore 12 will generally be spaced about 4 to about 16 shots per foot. In a preferred embodiment of this procedure, perforation tunnels can be made by in-line shots using zero degree or 180 degree phasing. Additional improvements can result by aligning the perforation tunnels in a preferred direction so that the desired fracture orientation is obtained. Other perforating directions can be selected as will be apparent to those skilled in the art.

Although FIGS. 1 and 2 depict hydraulic fracturing in a vertical wellbore, the method of this invention can also be used in horizontal and deviated wellbores. A hydraulic fracturing technique which can be utilized herein is disclosed in U.S. Pat. No. 3,929,191 which is hereby incorporated by reference. This patent also contains a more detailed description of standard industry practices wherein heat curable particles are used in hydraulic fracturing and gravel pack completion operations.

In another embodiment, a fracturing fluid as mentioned above is pumped into the bottom of wellbore 12 where it fills it to a predetermined level above perforation tunnels 18. When the perforation tunnels are covered, pump pressure will increase. The fracturing fluid containing the resin-coated particulate material is forced through perforation tunnels 18 by maintaining a higher pressure within wellbore 12. A process of this type is referred to in gravel packing technology as pressure packing or pre-packing perforations. Once the injecting or pumping pressure has increased, injection of the fracturing fluid into perforation tunnels 18 is ceased.

The pressure utilized in this embodiment remains below the fracturing pressure of the formation. Liquid contained in the fracturing fluid flows into formation 10 while the resin-coated particulate matter fills perforation tunnels 18 and wellbore 12. As was mentioned previously, the resin-coated particulate material is allowed to remain in perforation tunnels 18 and wellbore 12 until the consolidation process is completed. Once the consolidation process is completed, a permeable, porous consolidated mass is formed within perforation tunnels 18, wellbore 12, and within any voids adjacent thereto. The filtration characteristics of the consolidated material is such as to prevent the flow of entrained solids in the hydrocarbonaceous fluids from wellbore 12. Once the resin-coated particulate material has consolidated to the extent desired in perforation tunnels 18 and wellbore 12, excess consolidated material is drilled out and circulated from wellbore 12. Consolidated porous material remains in perforation tunnels 18 and in void areas outside of cement sheath 14 adjacent to formation 10. In the latter embodiment, the density of the perforation tunnels made in the wellbore will be spaced so as to be about 4 to about 16 shots per foot with no preferred phasing.

Additionally, perforation washing or surging techniques, familiar to those skilled in the art, may be employed prior to pressure packing with the fracturing fluid. Utilization of either of the preferred embodiments provides a means for improved "gravel" placement within perforations and when fracturing, and provides improved "gravel" placement within a fracture. This increases the probability that all perforations will be treated with the fracturing fluid containing the resin-coated consolidated material. The resin-coated consolidated material or "gravel" will have sufficient strength to remain in place so as to constrain the movement of formation solids. In this manner, the need for a retaining screen is eliminated.

The resin-coated particulate material can comprise sand or "gravel". This resin-coated consolidated material may be either sand or a synthetic particulate known in hydraulic fracturing terminology as an intermediate strength proppant, or "ISP". Two products that can be used for this purpose are Super Sand which is manufactured by Santrol Products, Inc. of Houston, Tex., and Acfrac CR, manufactured by Acme Resin Company of Westchester, Ill. Super Sand and Acfrac materials are discussed in U.S. Pat. No. 4,888,240 which issued on Dec. 19, 1989. Another coated particulate material which can be utilized is disclosed by Armbruster in U.S. Pat. No. 4,694,905, which issued on Sep. 22, 1987. These patents are hereby incorporated by reference herein.

U.S. Pat. No. 4,888,240 discusses a high strength self-consolidating particle comprised of a particulate substrate, a substantially cured inner resin coating and a fusible curable outer resin coating. When the particle is placed into a formation, ambient formation temperature heats its outer resin coating. Initially, the resin fuses and unites at contact areas between contiguous particles or with the formation walls. As the temperature increases, the polymerization reaction proceeds until the resin is cured into an insoluble and infusible cross-linked state. The pendular regions between adjacent particles bond the packed particles into a permeable mass having considerable compressive strength.

Although the present invention has been described with preferred embodiments, it is to be understood that variations and modifications may be resorted to without departing from the spirit and scope of this invention, as those skilled in the art will readily understand. Such variations and modifications are considered to be within the purview and scope of the appended claims.

What is claimed:

1. A method for controlling solids contained in hydrocarbonaceous fluids produced from a subterranean formation comprising:

a) perforating a wellbore at a productive interval of a hydrocarbonaceous fluid-containing formation;

b) injecting into said productive interval via perforations a fracturing fluid containing a resin-coated self-consolidating particulate material which is of a size and composition sufficient to prop a created fracture and form a permeable consolidated mass therein;

c) fracturing hydraulically said productive interval and thereafter creating a propped fracture with a self-consolidated permeable mass therein as well as within said perforations and wellbore which mass has filtration properties and composition sufficient to restrain solids entrained in said hydrocarbonaceous fluid; and d) removing mechanically the consolidated permeable mass from said wellbore which allows hydrocarbonaceous fluids to be produced from the formation substantially solids free which solids are restrained by the permeable consolidated mass within the fracture and perforations.

2. The method as recited in claim 1 where in step b) said particulate material comprises resin-coated sand or a resin-coated synthetic particulate material.

3. The method as recited in claim 1 where in step b) said perforations are shot in-line by utilizing 0 or 180 degree phasing.

4. The method as recited in claim 1 where in step b) the perforations are aligned in a desired direction so as to obtain a preferred fracture orientation.

5. The method as recited in claim 1 where in step a) the wellbore is vertical, horizontal, or deviated.

6. The method as recited in claim 1 where in step b) the perforations are spaced in said wellbore at a density of about 4 to about 16 shots per foot.

7. The method as recited in claim 1 where in step d) the consolidated mass is removed from said wellbore by drilling and circulating undesired consolidated mass from the wellbore.

* * * * *